US007065816B2

(12) United States Patent
McGettigan

(10) Patent No.: US 7,065,816 B2
(45) Date of Patent: Jun. 27, 2006

(54) MATTRESS

(76) Inventor: Patricia McGettigan, 20 Ailesbury Road, Dublin 2 (IE)

( * ) Notice: Subject to any disclaimer, the term of this patent is extended or adjusted under 35 U.S.C. 154(b) by 0 days.

(21) Appl. No.: 10/474,064

(22) PCT Filed: Mar. 28, 2002

(86) PCT No.: PCT/IE02/00041

§ 371 (c)(1),
(2), (4) Date: Jul. 6, 2004

(87) PCT Pub. No.: WO02/078494

PCT Pub. Date: Oct. 10, 2002

(65) Prior Publication Data

US 2004/0237205 A1 Dec. 2, 2004

(30) Foreign Application Priority Data

Mar. 30, 2001 (IE) ..... S2001/0323

(51) Int. Cl.
*A47C 27/16* (2006.01)

(52) U.S. Cl. ..... 5/731; 5/735; 5/740; 5/900.5; 5/901; 5/727

(58) Field of Classification Search ..... 5/731–735, 5/739, 740, 727, 730, 900.5, 901, 930
See application file for complete search history.

(56) References Cited

U.S. PATENT DOCUMENTS

| | | | | |
|---|---|---|---|---|
| 4,021,872 | A * | 5/1977 | Powell | 5/722 |
| 4,665,573 | A * | 5/1987 | Fiore | 5/731 |
| 5,224,226 | A * | 7/1993 | Groenewald | 5/733 |
| 5,369,824 | A * | 12/1994 | Powell | 5/735 |
| 5,400,449 | A * | 3/1995 | Satto | 5/631 |
| 5,669,094 | A * | 9/1997 | Swanson | 5/740 |
| 5,960,496 | A * | 10/1999 | Boyd | 5/722 |
| 6,052,851 | A * | 4/2000 | Kohnle | 5/690 |
| 6,159,574 | A * | 12/2000 | Landvik et al. | 428/71 |
| 6,256,822 | B1 * | 7/2001 | Weston et al. | 5/732 |
| 6,334,442 | B1 * | 1/2002 | Altamura | 128/845 |

FOREIGN PATENT DOCUMENTS

| | | | |
|---|---|---|---|
| DE | 3805980 | A1 * | 9/1988 |
| EP | 077988 | A1 * | 6/1997 |
| FR | 2687294 | A1 * | 8/1993 |

* cited by examiner

*Primary Examiner*—Michael Trettel
(74) *Attorney, Agent, or Firm*—Curtis L. Harrington

(57) ABSTRACT

A mattress (10) comprises a support base (12) defining an interface surface (14) at the top thereof and a softer compressible layer (22) overlying the interface surface. The thickness of the support base varies along a longitudinal direction such that the interface surface (14) defines a concave laterally extending channel between first and second support surfaces (16,20) for the upper and lower halves of a user's body respectively, and the compressible layer (22) substantially follows the profile of the interface surface (14). The mattress (10) is particularly useful for a pregnant woman who can comfortably lie on her back, side or front.

19 Claims, 7 Drawing Sheets

MATTRESS

This invention relates to mattresses or like supports for the resting body.

Conventional mattresses are flat cushioned supports which can cause or aggravate orthopaedic problems. They may be particularly uncomfortable for pregnant women, due to the increasing shape, size and weight of the woman's abdomen as pregnancy proceeds.

Lying on the back may be the only option available to the woman for the second half of the term of pregnancy, but many people can find it difficult to sleep on their backs. Very often the only position which might provide any degree of comfort, namely sleeping on the front, is denied due to the discomfort and to the fear of injuring the developing fetus.

Furthermore, the weight of the fetus can cause lower back strains from normal activities, and these strains are aggravated by having to sleep on one's back. The relief which can be provided by massage in such cases may also be difficult to provide due to the fact that a massage for relief of lower back pain generally requires the subject to lie on her front.

While a number of body supports have been proposed for pregnant women, these are generally designed to overlie a conventional mattress which places the women on a different level from her partner and which necessitates the women having to climb onto a higher than normal surface when going to bed.

Apart from addressing the problems faced by pregnant women, the present invention is also concerned with providing a mattress which is more comfortable for all users, and particularly for use in alleviating back pain and other orthopaedic problems. The invention has as a further object the provision of a mattress which can be used before, during and after pregnancy.

The invention provides a mattress comprising a support base of a supportive resilient material defining an interface surface at the top thereof and a compressible layer of a material softer than the base material overlying the interface surface, wherein the thickness of the support base varies along a longitudinal direction such that the interface surface defines a concave laterally extending channel between first and second support surfaces for the upper and lower halves of a user's body respectively, and wherein said compressible layer is of a substantially constant thickness along said longitudinal direction and substantially follows the profile of the interface surface.

Preferably the level of the first support surface is higher above that of the second support surface.

It will be appreciated that terms such as "higher", "lower", "above", "below", etc. are relative terms only used to indicate the relative positions of elements when the mattress is in normal use lying on a flat surface.

Further, preferably, both the first and second support surfaces slope downwards away from the channel.

Preferably, the first support surface slopes away from the channel at an angle of less than 10 degrees and said compressible layer is of an increasing thickness above said first surface to provide a flat upper surface for said compressible layer in the region of the first support layer.

The mattress may further include a cover layer overlying the compressible layer, with said cover layer being of a cushioning material.

In preferred embodiments, the ends of the channel are built up with a pair of shaped end bolsters such that the channel and bolsters together define a concave rounded hollow of a shape and size to accommodate the abdomen of a pregnant woman.

The mattress may further include a removable shaped insert of a shape and size to fit into said concave rounded hollow and reduce the depth thereof.

Preferably in such cases the insert is formed of at least two layers of material, namely a layer of said resilient support material and a layer of said soft compressible material.

In a further preferred aspect of the invention, the mattress is provided with means for attachment to an adjacent mattress, to form a double mattress.

In a further aspect the invention provides a removable insert for a mattress, comprising a lower layer of a supportive resilient material and an upper layer of a compressible material softer than the base material, with optionally a cover layer of cushioning material.

Preferably, the insert has a domed lower surface and a substantially flat upper surface.

The invention will now be further illustrated by the following descriptions of embodiments thereof given by way of example only with reference to the accompanying drawings, in which.

Figure 1:
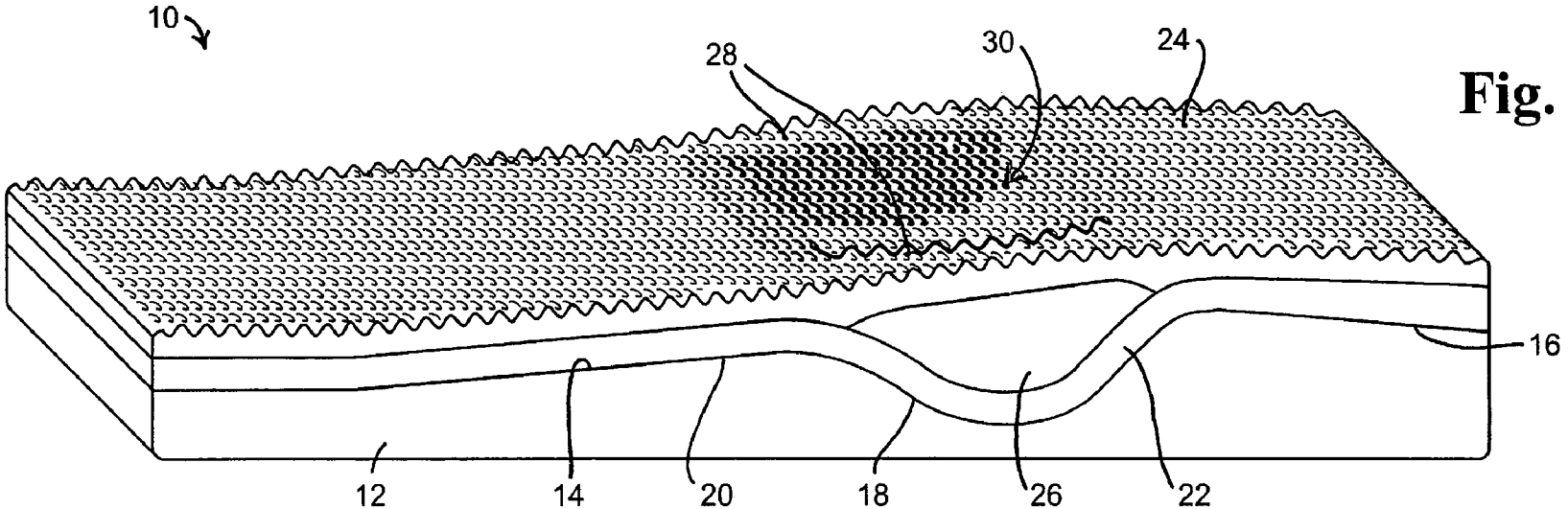
FIG. 1 is a perspective view of a first embodiment of mattress according to the invention.

FIG. 1 shows a first mattress 10 according to the invention for use by a woman before, during and after pregnancy. The mattress comprises a support base 12 of polyurethane foam having a density of 35 kg/m$^3$ This supportive resilient material defines an interface surface 14 having a first support surface 16 for the upper portion of a user's body, a concave laterally extending channel 18 adjacent the first surface for supporting the mid-section of the user's body, and a second support surface 20 adjacent the channel 18 for supporting the legs of the user.

A soft compressible layer 22 of visco-elastic foam (available from Kaymed) overlies the support base. This polymer material is a memory foam which adapts to the shape of the user's body and returns to its original shape when uncompressed. The compressible layer 22 is of substantially constant thickness and therefore mimics the shape of the interface surface. A cover layer 24 of a polyurethane foam overlies the compressible layer 14.

A bolster 26 made of the same visco-elastic polymer as the compressible layer is provided at each end of the channel to define a pair of raised sides 28 between which a rounded concavity 30 is defined in the top surface 32 of the mattress as will be explained in greater detail below.

The supportive resilient material could be a sprung base having the required degree of firmness, but polyurethane foams are the preferred choice.

Latex foams may also be used, as can other foam materials having the required properties as set out herein.

Figure 2:
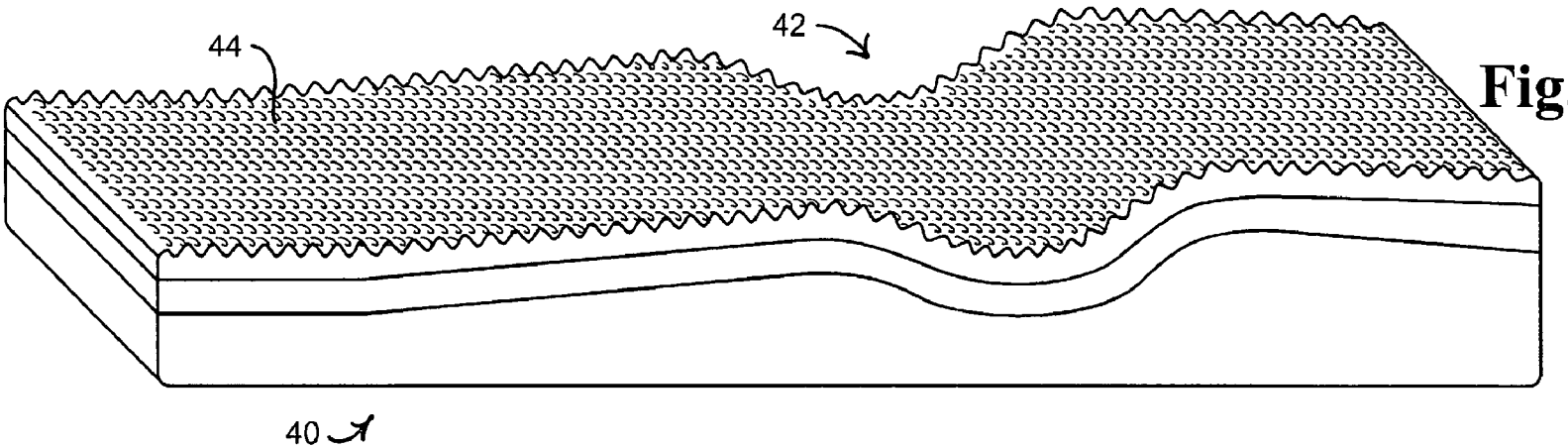
FIG. 2 is a perspective view of a second embodiment of mattress according to the invention.

FIG. 2 shows a similar mattress 40 to that of FIG. 1, except that the bolsters are omitted and therefore the shape of the channel, indicated generally at 42, is maintained at the top surface 44 of the mattress.

Figure 3:
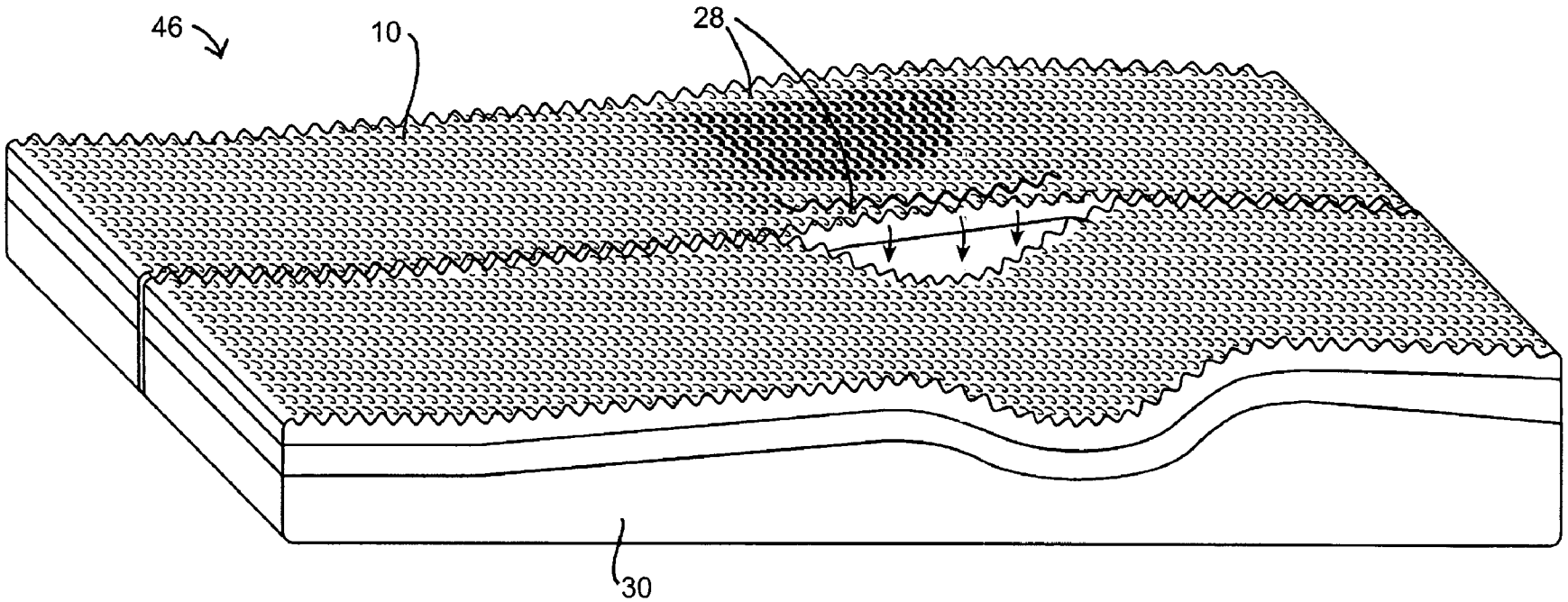
FIG. 3 is a perspective view of the mattresses of FIGS. 1 and 2 connected to one another, thereby providing a double mattress according to the invention.

FIG. 3 shows a double mattress 46 according to the invention formed by placing the mattresses 10,30 of FIGS. 1 and 2 side by side and attaching them together by suitable means (not shown) such as with zippers or with Velcro (™) strips.

As the raised sides 28 of mattress 10 result from the compressible material bolsters rather than the support base resilient foam, these raised sides do not interfere to any great extent with movement in the bed. When the weight of a body is placed on the raised side 28 in the centre of the double mattress, it simply collapses sideways as indicated by the arrows.

Figure 4:
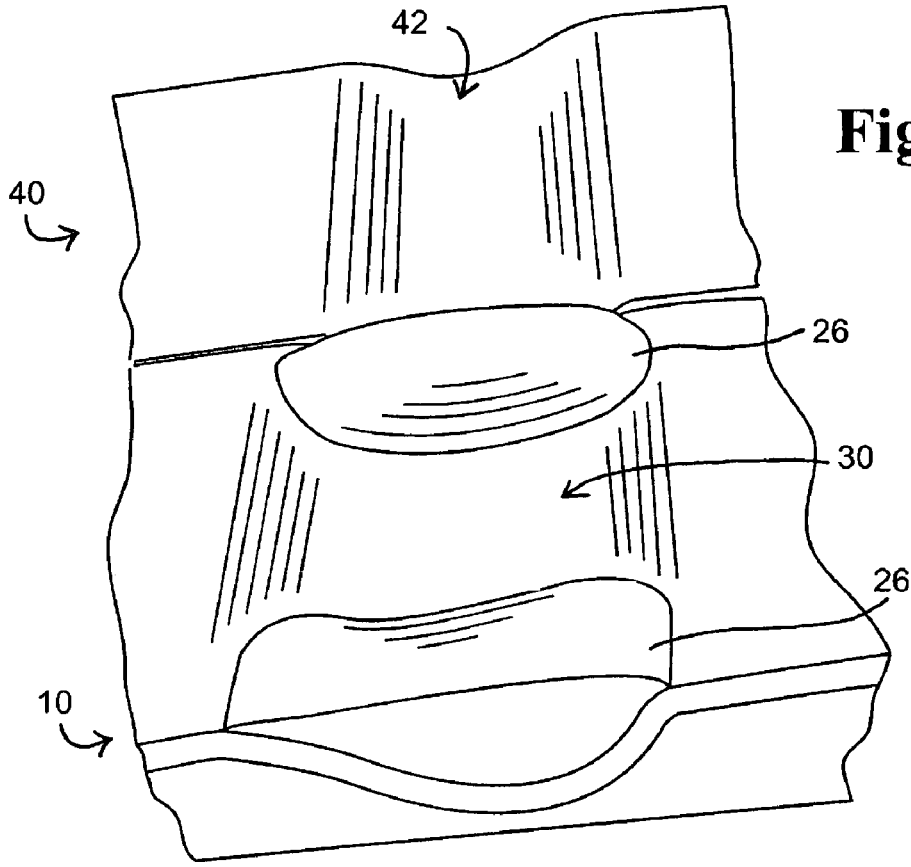
FIG. 4 is a perspective view of the central part of the double mattress of FIG. 3 with the top cover layers removed.

FIG. 4 shows the double mattress 46 from the opposite side with the cover layers removed, to illustrate the shape of the hollow concavity 30 and the channel 42 in mattresses 10,40, respectively. It can be seen that the channel 18 of the woman's mattress 10 is larger than that of the partner's mattress 40, due to the fact that the latter mattress only requires a channel of a size to accommodate the buttocks of the partner, while the former mattress must accommodate the swollen abdomen of a pregnant woman. The bolsters 26 can be seen clearly, defining the hollow concavity 30.

Figure 5:
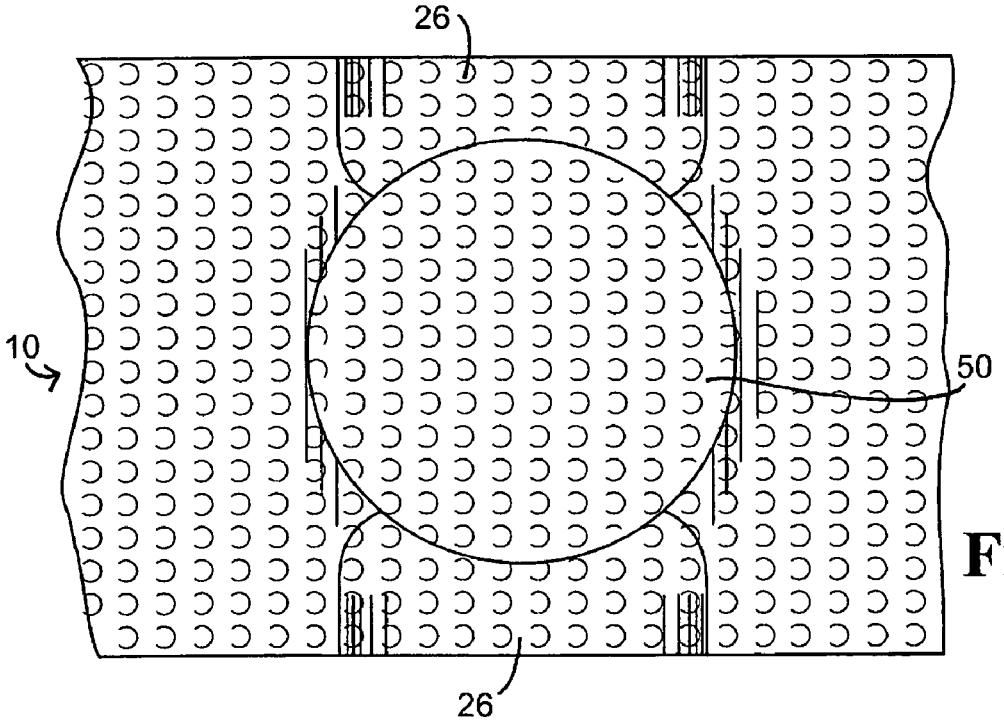
FIG. 5 is a plan view from above of the central part of the mattress of FIG. 1 with the insert in place.
Figure 6:
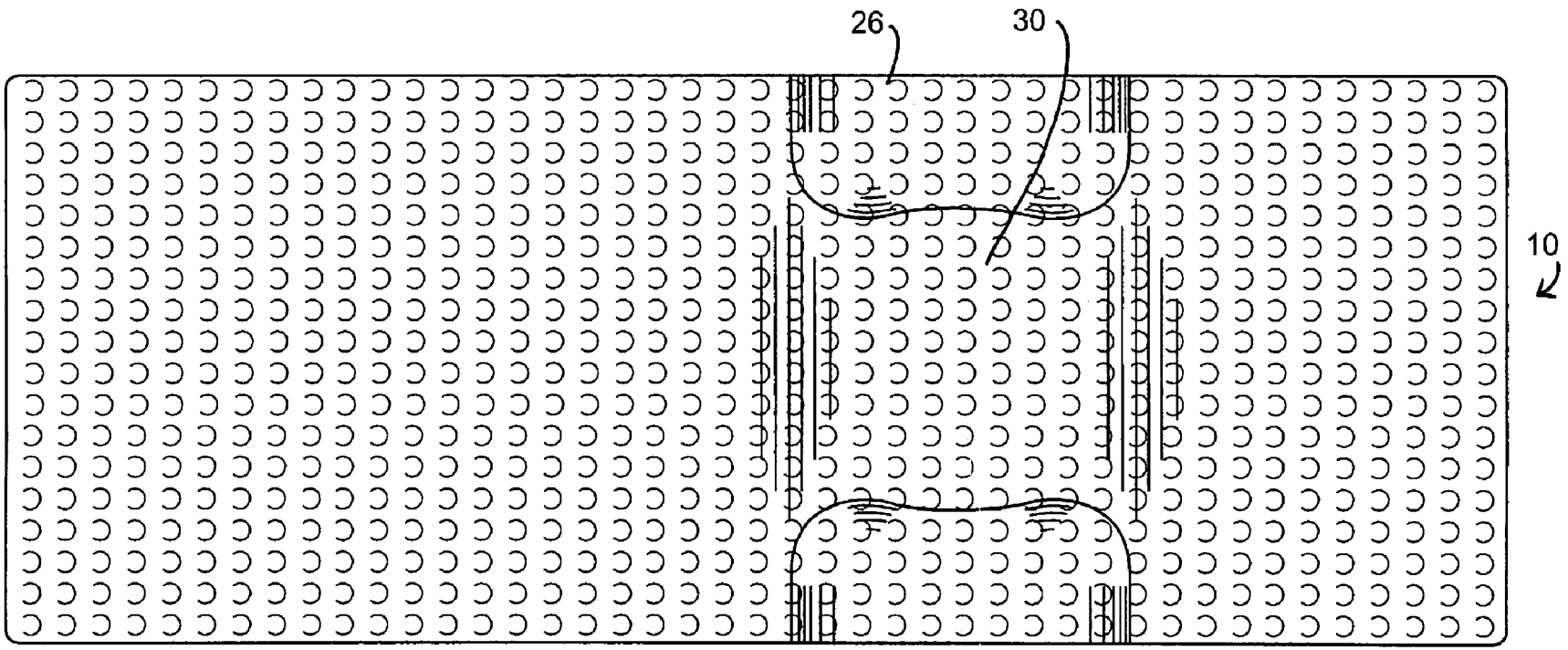
FIG. 6 is a plan view from above of the central part of the mattress of FIG. 1 with the insert removed.
Figures 7A, 7B:
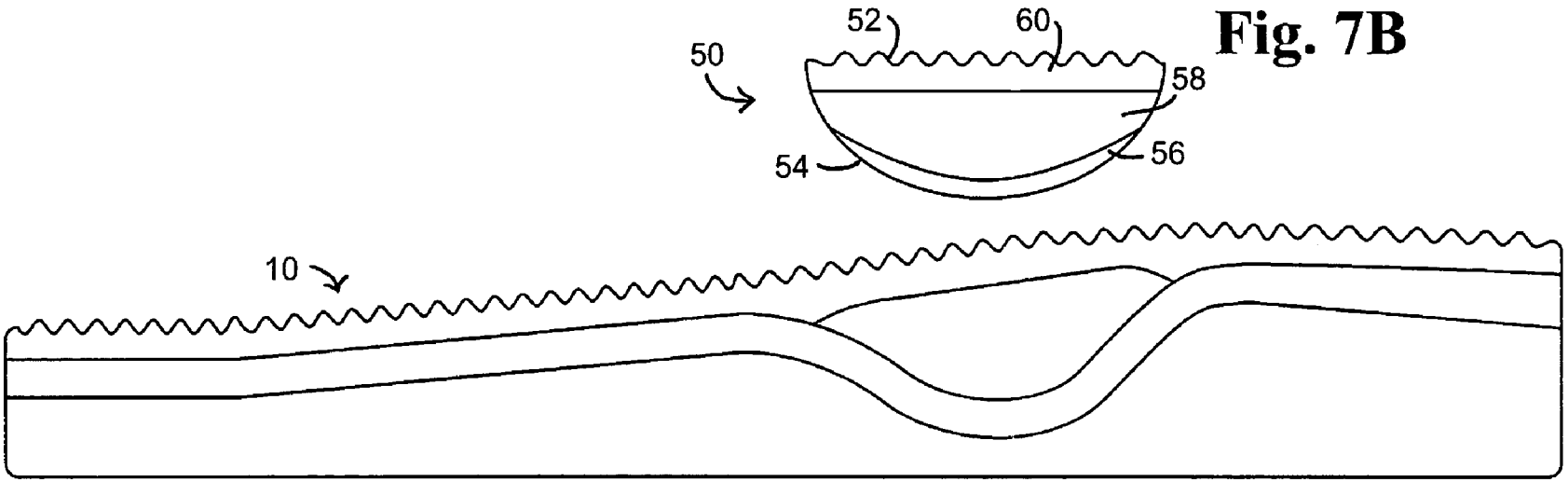
FIG. 7A is a side sectional elevation of the mattress of FIG. 1.
FIG. 7B is a side sectional elevation of the insert for the mattress of FIG. 1.
Figure 8:
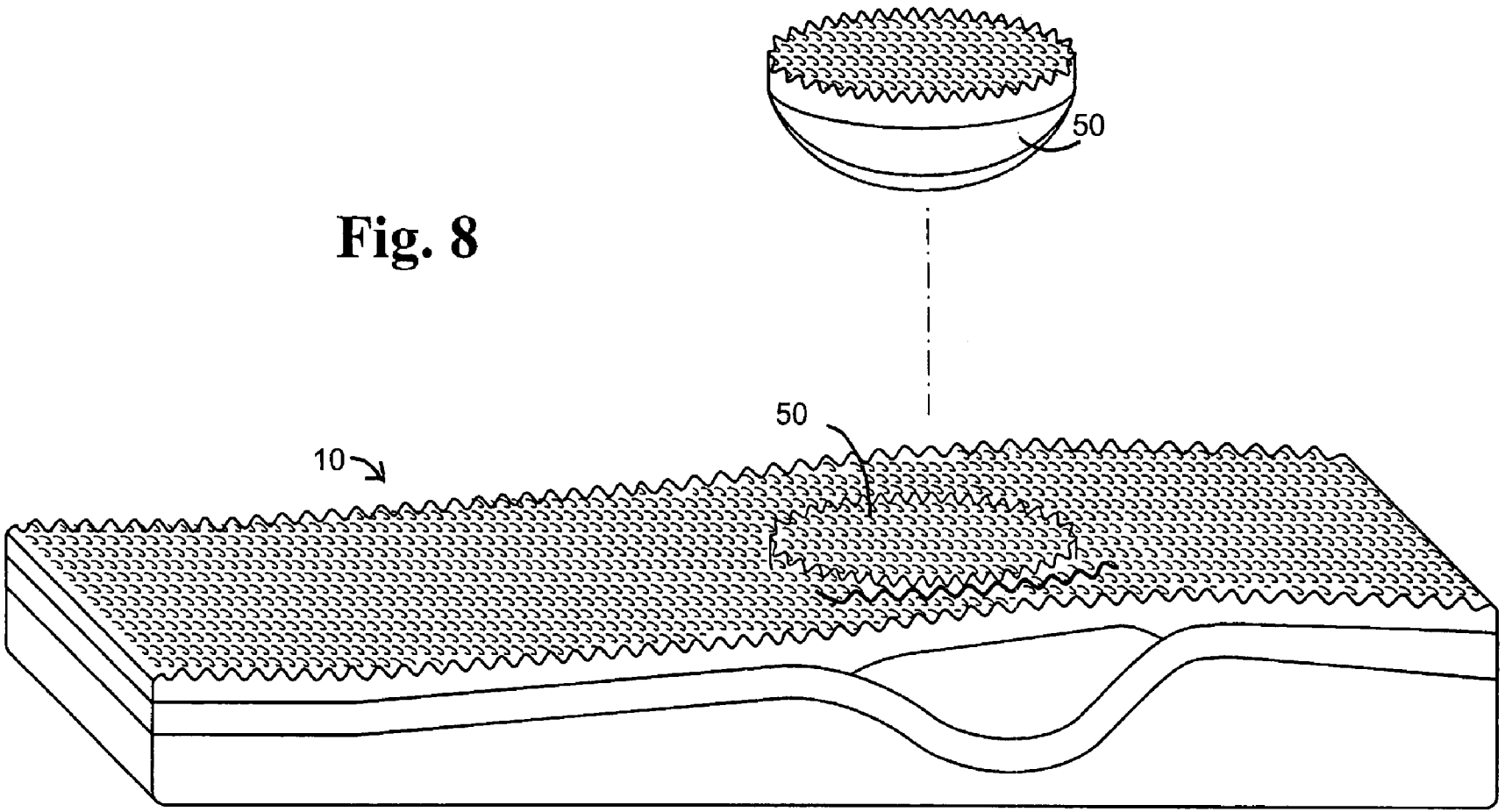
FIG. 8 is a perspective view of the mattress of FIG. 1 showing the insert both before and after insertion.

As the mattress 10 is designed for use before and after pregnancy as well as during pregnancy, the mattress has an insert 50 which can sit into the concavity 30 to fill the hollow. FIG. 5 shows the mattress 10 with the insert present, and FIG. 6 shows the same view with the insert removed. FIGS. 7A and 7B respectively show the mattress and the insert in sectional side elevation taken along the centre line of the mattress. The insert 50 has a flat top surface 52 and a domed lower surface 54 shaped to fit into the hollow concavity 30. The insert is formed of three layers 56,58,60 made of the same materials as the base, compressible layer and cover layer, respectively, of the mattress. This ensures that the correct degree of support is maintained, while also providing a soft compressible insert which will give way under the weight of the woman to accommodate the buttocks in normal use, mimicking to a certain extent the qualities of the partner's mattress. FIG. 8 is a perspective view of the insert 50 and the mattress 10, with the insert shown both before and after insertion.

Figure 9:
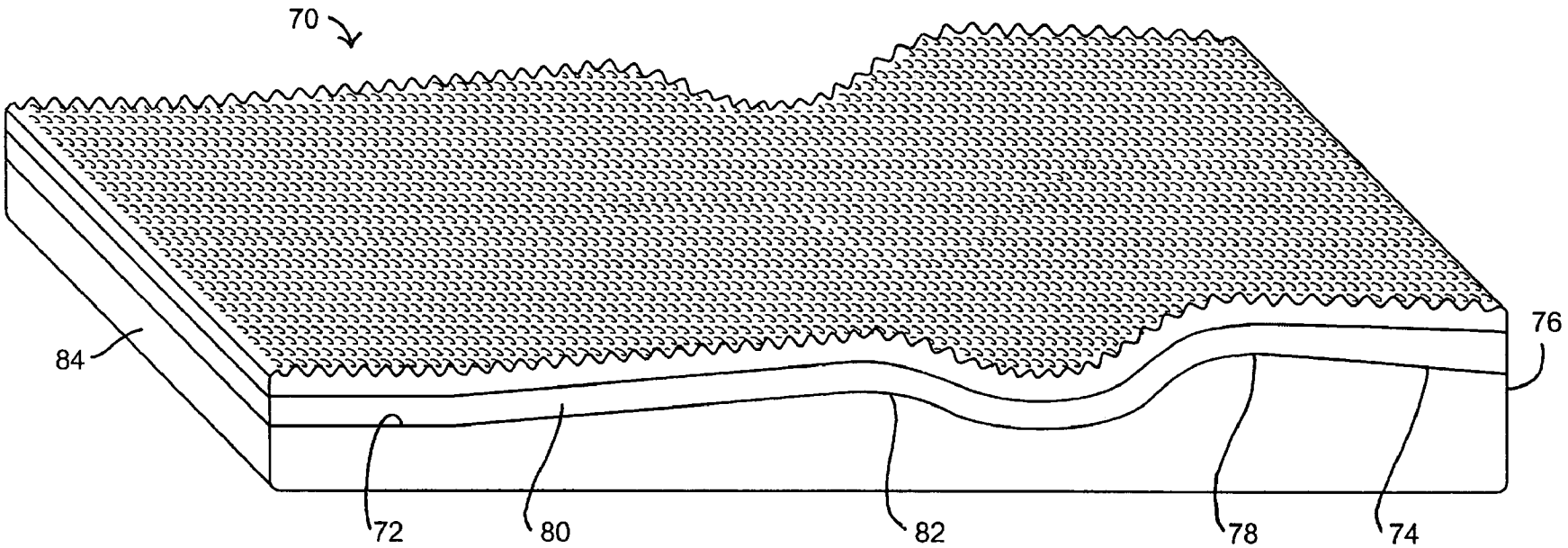
FIG. 9 is a perspective view of a further double mattress according to the invention.

FIG. 9 shows a further double mattress 70 according to the invention which is generally similar to that of, FIG. 2 but is widened to a double width. The shape of the interface surface 72 will now be described in more detail, and it will be appreciated that the same general shape applies to the mattresses of FIGS. 1 and 2.

The first support region 74 is sloped gently upwards from the head end 76 to the point 78 at which the channel begins. This area supports the head, shoulders and upper back of the user. It can be seen that while the compressible layer 80 is of substantially constant thickness along its length, it is in fact slightly thicker at the head end. This makes the top surface of the mattress above this first area flat, but more compressible towards the head end.

The point 78 at which the channel begins supports the lumbar region of the spine when the user lies on his or her back or side. The channel then accommodates the lower back, buttocks and upper thighs of the user. The channel ends at a point 82 which is lower than the point 78 at which it begins. This means that the legs are at a lower elevation than the upper body, which aids breathing and assists in drainage of the lymphatic system.

The second support region of the interface surface slopes away from point 82 to the foot end 84, although it flattens out towards the foot end for better user comfort.

The shape of the mattress thus provided aids in alleviating spinal problems by conforming to the curvature of the spine and providing better support. The user can lie comfortably on the back, side or front.

The invention claimed is:

1. A mattress comprising a support base of a supportive resilient material defining an interface surface at the top thereof and a compressible layer of a material softer than the base material overlying the interface surface, wherein the thickness of the support base varies along a longitudinal direction such that the interface surface defines a concave laterally extending channel between first and second support surfaces for the upper and lower halves of a user's body respectively, wherein both the first and second support surfaces slope downwards away from the channel, wherein the first support surface slopes away from the channel at an angle of less than 10 degrees, and wherein said compressible layer substantially follows the profile of the interface surface, the mattress further comprising a cover layer overlying the compressible layer, with said cover layer being of a cushioning material.

2. A mattress as claimed in claim 1, wherein the level of the first support surface is higher than that of the second support surface in normal use.

3. A mattress as claimed in claim 1, wherein the ends of the channel are built up with a pair of shaped end bolsters such that the channel and bolsters together define a concave rounded hollow of a shape and size to accommodate the abdomen of a pregnant woman.

4. A mattress as claimed in claim 3, further comprising a removable shaped insert of a shape and size to fit into said concave rounded hollow and reduce the depth thereof.

5. A mattress as claimed in claim 4, wherein the insert is formed of at least two layers of material, namely a layer of said resilient support material and a layer of said soft compressible material.

6. A mattress as claimed in claim 1, wherein said resilient support material comprises a sprung support.

7. A mattress as claimed in claim 1, wherein said resilient support material comprises a foam material.

8. A mattress as claimed in claim 1, wherein said soft compressible material is visco-elastic memory foam.

9. A mattress comprising a support base of a supportive resilient material defining an interface surface at the top thereof and a compressible layer of a material softer than the base material overlying the interface surface, wherein the thickness of the support base varies along a longitudinal direction such that the interface surface defines a concave laterally extending channel between first and second support surfaces for the upper and lower halves of a user's body respectively, wherein both the first and second support surfaces slope downwards away from the channel, wherein the first support surface slopes away from the channel at an angle of less than 10 degrees, and wherein said compressible layer substantially follows the profile of the interface surface and means for attachment to an adjacent mattress, to form a double mattress.

10. A double mattress comprising a mattress as claimed in claim 9 when connected to a mattress as claimed in any preceding claim.

11. A double mattress as claimed in claim 10, wherein one of said mattresses is a mattress as claimed in claim 3.

12. A mattress comprising a support base of a supportive resilient material defining an interface surface at the top thereof and a compressible layer of a material softer than the base material overlying the interface surface, wherein the thickness of the support base varies along a longitudinal direction such that the interface surface defines a concave laterally extending channel between first and second support surfaces for the upper and lower halves of a user's body respectively, wherein both the first and second support surfaces slope downwards away from the channel, and wherein said compressible layer substantially follows the profile of the interface surface and said compressible layer is of an increasing thickness above said first surface to provide a flat upper surface for said compressible layer in the region of the first support layer.

13. A mattress as claimed in claim 12, wherein the level of the first support surface is higher than that of the second support surface in normal use.

14. A mattress as claimed in claim 12, wherein the ends of the channel are built up with a pair of shaped end bolsters such that the channel and bolsters together define a concave rounded hollow of a shape and size to accommodate the abdomen of a pregnant woman.

15. A mattress as claimed in claim 12, wherein said resilient support material comprises a sprung support.

16. A mattress as claimed in claim 12, wherein said resilient support material comprises a foam material.

17. A mattress as claimed in claim 12, wherein said soft compressible material is visco-elastic memory foam.

18. A mattress as claimed in claim 12, further comprising means for attachment to an adjacent mattress, to form a double mattress.

19. A double mattress comprising a mattress as claimed in claim 18 when connected to a mattress as claimed in any preceding claim.

* * * * *